US007067045B2

(12) United States Patent
Keigler et al.

(10) Patent No.: US 7,067,045 B2
(45) Date of Patent: Jun. 27, 2006

(54) METHOD AND APPARATUS FOR SEALING ELECTRICAL CONTACTS DURING AN ELECTROCHEMICAL DEPOSITION PROCESS

(75) Inventors: Arthur Keigler, Wellesley, MA (US); Harald Herchen, Los Altos, CA (US); Vincent E. Burkhart, San Jose, CA (US); Son N. Trinh, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 482 days.

(21) Appl. No.: 10/274,722

(22) Filed: Oct. 18, 2002

(65) Prior Publication Data

US 2004/0074762 A1 Apr. 22, 2004

(51) Int. Cl.
*C25B 9/02* (2006.01)

(52) U.S. Cl. ..... 204/297.06; 204/297.01; 204/297.07; 204/297.08; 204/297.09; 204/297.1; 204/286.1; 204/287

(58) Field of Classification Search ..... 204/224 R, 204/279, 297.01, 297.8, 297.08, 297.09, 204/297.1, 286.1, 287
See application file for complete search history.

(56) References Cited

U.S. PATENT DOCUMENTS

| | | | | |
|---|---|---|---|---|
| 6,251,236 | B1 | 6/2001 | Stevens | 204/224 R |
| 6,322,678 | B1 | 11/2001 | Woodruff et al. | 204/297.08 |
| 6,423,636 | B1 | 7/2002 | Dordi et al. | 438/678 |
| 6,527,926 | B1 * | 3/2003 | Woodruff et al. | 204/297.08 |
| 6,589,401 | B1 * | 7/2003 | Patton et al. | 204/212 |

* cited by examiner

*Primary Examiner*—Bruce F. Bell
(74) *Attorney, Agent, or Firm*—Patterson & Sheridan LLP

(57) ABSTRACT

An apparatus for securing a substrate in an electrochemical deposition system is provided. The apparatus generally includes a substrate support member adapted to receive the substrate and a thrust plate assembly adapted to exert a downward force on the substrate. For some embodiments, a first sealing member adapted to engage a plating surface of the substrate may be attached to the substrate support member. The apparatus may also include a second sealing member adapted to engage a non-plating surface of the substrate or a surface of the substrate support member to prevent the flow of plating fluid to a non-plating surface of the substrate. The apparatus may also include electrical contacts to electrically contact the plating or non-plating surface of the substrate.

23 Claims, 6 Drawing Sheets

METHOD AND APPARATUS FOR SEALING ELECTRICAL CONTACTS DURING AN ELECTROCHEMICAL DEPOSITION PROCESS

BACKGROUND OF THE INVENTION

1. Field of the Invention

Embodiments of the invention generally relate to electrochemical plating and, more particularly, to an apparatus for securing a substrate in an electrochemical plating system.

2. Description of the Related Art

Metallization of sub-quarter micron sized features is a foundational technology for present and future generations of integrated circuit manufacturing processes. More particularly, in devices such as ultra large scale integration-type devices, i.e., devices having integrated circuits with more than a million logic gates, the multilevel interconnects that lie at the heart of these devices are generally formed by filling high aspect ratio (greater than about 4:1, for example) interconnect features with a conductive material, such as copper or aluminum, for example. Conventionally, deposition techniques such as chemical vapor deposition (CVD) and physical vapor deposition (PVD) have been used to fill these interconnect features. However, as the interconnect sizes decrease and aspect ratios increase, void-free interconnect feature fill via conventional metallization techniques becomes increasingly difficult. As a result thereof, plating techniques, such as electrochemical plating (ECP) and electroless plating, for example, have emerged as promising processes for void free filling of sub-quarter micron sized high aspect ratio interconnect features in integrated circuit manufacturing processes.

In an ECP process, for example, sub-quarter micron sized high aspect ratio features formed into the surface of a substrate (or a layer deposited thereon) may be efficiently filled with a conductive material, such as copper, for example. ECP processes are generally two stage processes, wherein a seed layer is first formed over the surface features of the substrate, and then the surface features of the substrate are exposed to a plating solution, while an electrical bias is simultaneously applied between the substrate and a copper anode positioned within the plating solution. The plating solution is generally rich in ions to be plated onto the surface of the substrate, and therefore, the application of the electrical bias causes these ions to be urged out of the plating solution and to be plated onto the seed layer.

Typically, the electrical bias is provided to the substrate via one or more electrical contacts. Commonly, the seed layer formed on the substrate may extend from a plating surface around beveled edges of the substrate to a non-plating surface. Accordingly, for different systems, the electrical contacts may be in electrical contact with either the plating surface or the non-plating surface. Regardless of location, it is generally desirable to isolate the electrical contacts, as well as the non-plating surface of the substrate from the plating material, to avoid undesirable plating thereon. Plating on the electrical contacts may alter the resistance of the electrical contacts and have a negative effect on the substrate plating uniformity. Plating on the non-plating surface may result in an extra processing step to remove the plating. The extra processing step may be costly, time consuming and place additional stress on the substrate.

Conventional approaches to isolate the electrical contacts and non-plating surface from the plating solution typically include providing one or more sealing elements to contact the same surface of the substrate as the electrical contacts.

For example, sealing members positioned to engage the plating surface may be placed adjacent electrical contacts positioned to contact the plating surface. The sealing members and electrical contacts also provide support for the substrate. However, the combination of the electrical contacts and the associated seals generally takes up several millimeters (generally between 3 and about 7 millimeters) of the perimeter of the plating surface area. Since this surface area is used to make electrical and seal contacts, the area cannot be used to support device formation.

In an effort to utilize this perimeter surface area, some systems may include sealing members positioned to engage the non-plating surface adjacent electrical contacts positioned to contact the non-plating surface. However, without sealing members or electrical contacts on the plating surface to support the substrate, some other means may be needed to support the substrate. Typically, a vacuum is applied to the substrate, to pull the non-plating surface up into contact with the sealing members and electrical contacts. However, the vacuum applied to the substrate may create a stress on the substrate, and may lead to substrate breakage. If the sealing members happen to leak, the vacuum may be unable to maintain the substrate against the electrical contacts with sufficient force and the plating solution may enter the vacuum, causing damage to the vacuum.

Therefore, there is a need for an improved apparatus for securing a substrate in an electrochemical plating system.

SUMMARY OF THE INVENTION

The present invention generally provides an apparatus for securing a substrate in a processing system, such as an electrochemical plating system.

For some embodiments, the apparatus generally includes a support member adapted to receive the substrate, the support member having a seal engaging means formed on a surface therein, a thrust plate assembly adapted to exert a securing force on the substrate to secure the substrate to the support member, and a sealing member attached to the thrust plate assembly, wherein the sealing member is adapted to exert a substantially radial sealing force against the seal engaging means.

For other embodiments, the apparatus generally includes a support member adapted to receive the substrate, the support member having an annular ring extending from a surface thereof, a thrust plate assembly adapted to exert a securing force on the substrate to secure the substrate to the support member, a plurality of electrical contacts adapted to engage the substrate, a first sealing member attached to the thrust plate assembly, wherein the first sealing member is adapted to exert a sealing force against the annular ring, wherein the sealing force is directed substantially radially inward towards a center of the support ring, and a second sealing member attached to the support member, the second sealing member adapted to engage a plating surface of the substrate.

For other embodiments, the apparatus generally includes a support member adapted to receive the substrate, a thrust plate assembly adapted to exert a securing force on the substrate to secure the substrate to the support member, a plurality of electrical contacts adapted to electrically contact a non-plating surface of the substrate, and a sealing member attached to the substrate support member adapted to engage a plating surface of the substrate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally provide an apparatus for securing a substrate in an electrochemical deposition system. According to some embodiments, a front side sealing member adapted to engage a plating surface of the substrate and a back side sealing member adapted to engage a substrate holding member may prevent the flow of plating fluid to electrical contacts and to a non-plating surface of the substrate.

Figure 1:
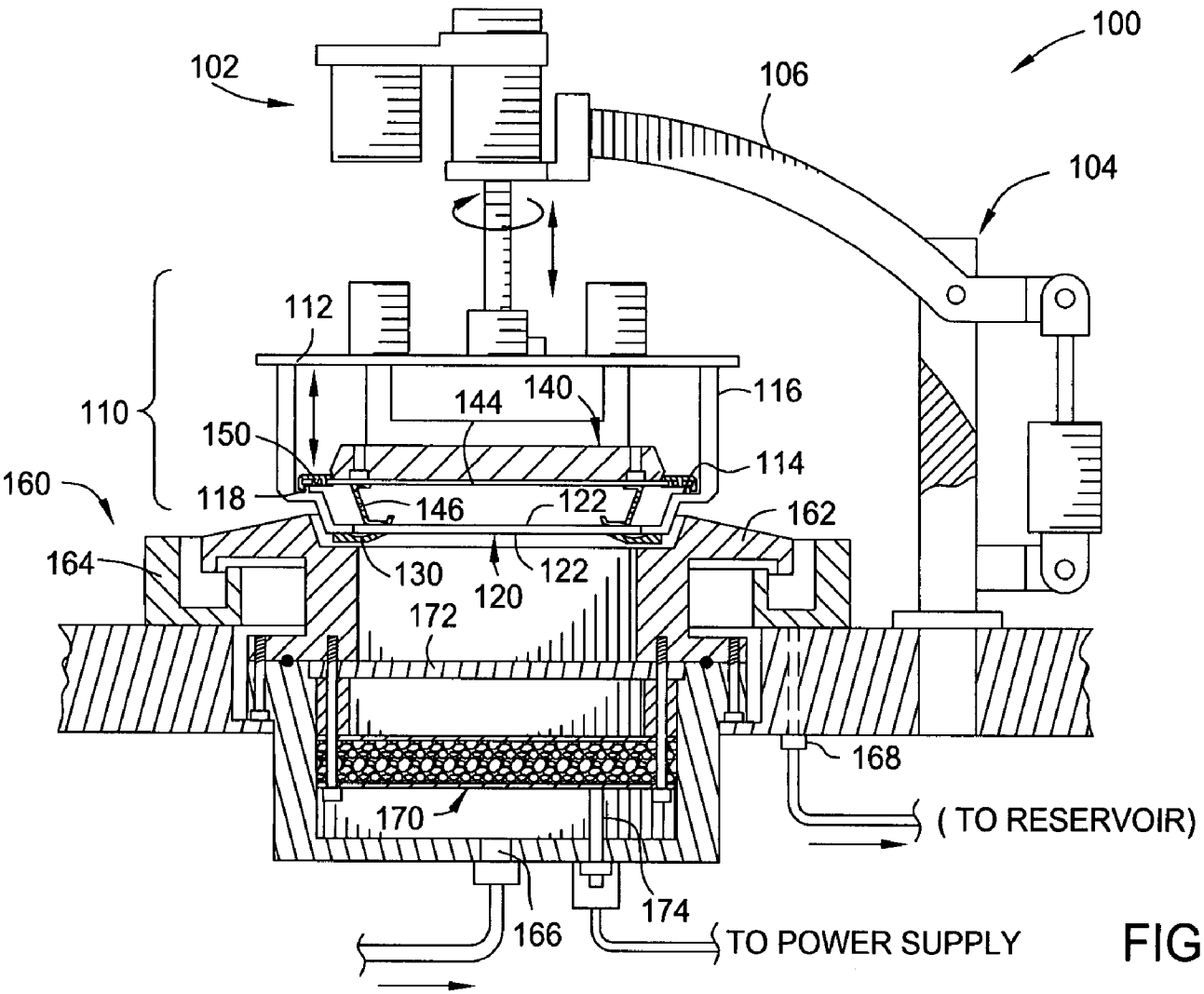
FIG. 1 illustrates an exemplary plating cell according to one embodiment of the present invention.

FIG. 1 illustrates a partial perspective and sectional view of an exemplary electrochemical plating (ECP) system 100 according to one embodiment of the present invention. The ECP system 100 generally includes a head assembly 102, a substrate holding assembly 110 and a plating bath assembly 160. The head assembly 102 is attached to a base 104 by a support arm 106. The head assembly 102 is adapted to support the substrate holding assembly 110 at a position above the plating bath assembly 160 in a manner that allows the head assembly 102 to position a substrate 120 (held in the substrate holding assembly 110) in a plating bath (not shown for clarity) for processing. The plating bath fills inner basin 162. The head assembly 102 may also be adapted to provide vertical, rotational, and angular movement to the substrate holding assembly 110 before, during, and after the substrate 120 is placed in the plating bath filling inner basin 162.

The plating bath assembly 160 generally includes an inner basin 162, contained within a larger diameter outer basin 164. Any suitable technique may be used to supply a plating solution to the plating assembly 160. For example, a plating solution may be supplied to the inner basin 162 through an inlet 166 at a bottom surface of the inner basin 162. The inlet 166 may be connected to a supply line, for example, from an electrolyte reservoir system (not shown). The outer basin 164 may operate to collect fluids from the inner basin 162 and drain the collected fluids via a fluid drain 168, which may also be connected to the electrolyte reservoir system.

An anode assembly 170 is generally positioned within a lower region of the inner basin 162. A membrane 172 may be generally positioned across the diameter of inner basin at a position above the anode assembly 170. The anode assembly 170 may be any suitable consumable or non-consumable-type anode. The membrane 172 may be any suitable type membrane, such as a cation membrane, an anion membrane, an uncharged-type membrane, or a multi-layer diffusion differentiated permeable membrane. Any suitable method may be used to provide an electrical connection to the anode assembly 170. For example, an electrical connection to the anode assembly 170 may be provided through an anode electrode contact 174. The anode electrode contact 174 may be made from any suitable conductive material that is insoluble in the plating solution, such as titanium, platinum and platinum-coated stainless steel. As illustrated, the anode electrode contact 174 may extend through a bottom surface of the plating bath assembly 160 and may be connected to an electrical power supply (not shown), for example, through any suitable wiring conduit.

Substrate Holding Assembly

The substrate holding assembly 110 generally includes a mounting member 112 attached to a substrate support member 114 via attachment members 116. The mounting member 112 may allow for attachment of the substrate holding assembly 110 to the head assembly 102. Other embodiments of the substrate holding assembly 110 may lack the mounting member 112 and may be attached, for example, directly to the head assembly 102 via the substrate support member 114. The mounting member 112, the substrate support member 114, and the attachment members 116 may each be coated with a material resistant to plating. For example, the members 112–116 may be coated in a PTFE material, such as Aflon®, or any other suitable plating-resistant coating material.

The substrate 120 typically has a (front side) plating surface 122 and a (back side) non-plating surface 124. The substrate support member 114 is generally adapted to receive the substrate 120 with the plating surface 122 of the substrate facing the plating bath filling inner basin 162. The substrate assembly may also include a thrust plate assembly 140 to exert a securing force on the substrate 120 for securing the substrate 120 to the substrate support member 114. For example, the thrust plate assembly 140 may be generally adapted to exert a downward force on the non-plating surface 124 of the substrate. The downward force applied by the thrust plate assembly 140 may be sufficient to ensure adequate sealing between a front side sealing member 130 and the plating surface 122 of the substrate. For some embodiments, the thrust plate assembly 140 may include an inflatable bladder assembly (not shown) to apply a downward force that is evenly distributed along the non-plating surface 124 of the substrate 120.

A seed layer is typically formed on the plating surface 122, with a portion of the seed layer extending around a beveled edge of the substrate 120 to the non-plating surface 124, thereby electrically connecting the non-plating surface 124 to the plating surface 122. The substrate holding assembly 110 may further include one or more electrical contacts 146 generally adapted to electrically contact the non-plating surface 124 or the beveled edge of the substrate in order to supply an electrical plating bias to the plating surface 122. The contacts 146 may be adapted in a generally circular pattern and may vary in number, for example, according to a size of the substrate 120. Further, the contacts 146 may be made of any suitable conductive material, such as copper (Cu), platinum (Pt), tantalum (Ta), titanium (Ti), gold (Au), silver (Ag), stainless steel or other conducting materials. The contacts 146 may also be flexible to contact non-plating surfaces with non-uniform heights.

Power may be supplied to the contacts 146 via a power supply (not shown). Electrical current supplied to the non-plating surface 124 through the contacts 146 may be conducted around the beveled edge of the substrate 120 to the plating surface 122 via an electrically conductive layer disposed on the non-plating surface 124. The electrically conductive layer may be a barrier layer, a diffusion layer, or an extension of the seed layer. The power supply may supply electrical power to all of the electrical contacts 146 cooperatively, banks or groups of the electrical contacts 146 separately, or to the individual contacts 146. In embodiments where current is supplied to groups or individual contacts 146, a current control system may be employed to control the current applied to each group or pin.

For some embodiments, the contacts 146 may be attached to the thrust plate assembly 140. Particularly, as illustrated, the contacts 146 may extend down from, and be electrically coupled to, an electrically conductive plate 144 of the thrust plate assembly 140. As with the contacts 146, the plate 144 may be made of any suitable electrically conductive material, and may be made of the same material as the contacts 146. Accordingly, power may be supplied to the contacts 146 by one or more electrical connections between the plate 144 and a power supply. The plate 144 may be connected to the power supply via any suitable attachment means adapted to provide power to the conductive plate 144 as the substrate holding assembly 110 is moved (i.e., raised, lowered and rotated) by the head assembly 102.

For other embodiments, however, electrical contacts may not be attached to the thrust plate assembly 140. For example, electrical contacts may extend from (and be attached to) the substrate support member 114. The thrust plate assembly 140 may be adapted to exert a downward force on the electrical contacts extending from the substrate support member 114 in order to make electrical contact with the non-plating surface 124.

The thrust plate assembly 140 may be adapted to be raised and lowered independently of the substrate holding assembly 110. For example, the thrust plate assembly 140 may be raised to provide a space between the thrust plate assembly 140 and the substrate support member 114 to permit removal of the substrate 120 from, or insertion of the substrate 120 into, the substrate holding assembly 110 using a robot device (not shown). Similarly, the thrust plate assembly 140 may be lowered to exert a downward force on the non-plating surface 124 with the contacts 146, which may ensure adequate electrical contact between the contacts 146 and the non-plating surface 124. As previously described, for some embodiments, the thrust plate assembly 140 may include an inflatable bladder assembly to provide an evenly distributed downward force to the non-plating surface 124. For other embodiments, however, the downward force applied to the non-plating surface 124 by the electrical contacts 146 may be sufficient to ensure adequate sealing between the front side sealing member 130 and the plating surface 122 of the substrate 120 without an inflatable bladder assembly.

Front Side and Back Side Sealing Members

The downward force may also press the plating surface 122 against a front side sealing member 130 attached to the substrate support member 114. Thus, a seal may be formed between the front side sealing member 130 and the plating surface 122, thereby preventing flow of plating solution around the beveled edge of the substrate 120 to the non-plating surface 124 and electrical contacts 146. However, as the substrate 120 is lowered into the plating bath 166, plating solution may also reach the non-plating surface 124 around an edge of the substrate support member 114. Therefore, the substrate holding assembly 110 may also include a back side sealing member 150 to prevent flow of plating solution around the edge of the substrate support member 114 to the non-plating surface 124. The back side sealing member 150 may be attached to the thrust plate assembly 140, and may engage a seal engaging means, such as an annular ring 118 formed in a top surface of the substrate support member 114. Hence, the back side sealing member 150 may isolate the non-plating surface 124 without physically contacting the wafer 120.

Figure 2:
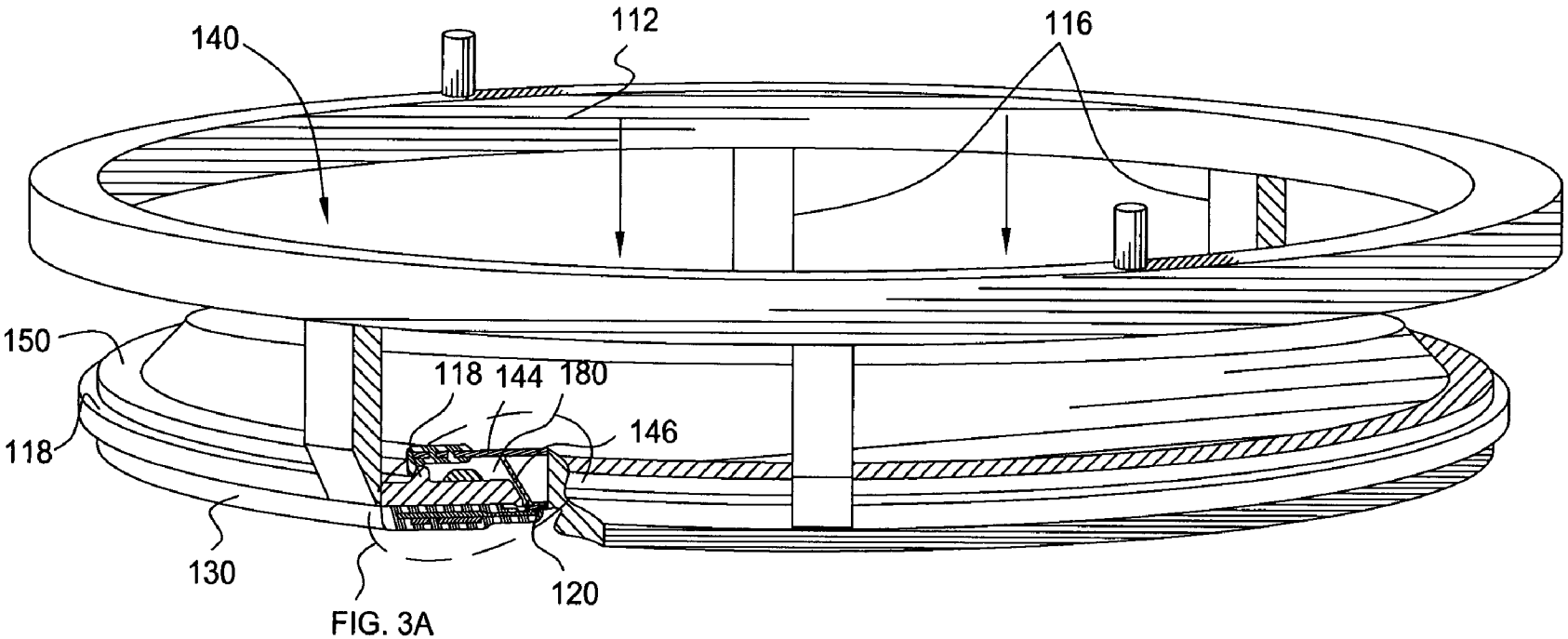
FIG. 2 is a perspective view of an exemplary substrate support member according to one embodiment of the present invention.

FIG. 2 is a side view of the substrate holding assembly 110 that shows the relative positions of the front side sealing member 130 and back side sealing member 150. As illustrated, the front side sealing member 130 and back side sealing member 150 may be formed as annular rings around the substrate support member 114 and thrust plate assembly 140, respectively. As the thrust plate assembly 140 is lowered to secure the substrate 120 against the front side seal 130, the back side sealing member 150 may engage the annular ring 118 formed in the top surface of the substrate support member 114.

Accordingly, a cavity 180 may be formed between the front side sealing member 130 and the back side sealing member 150. For some embodiments, the cavity 180 may be pressurized with a fluid (e.g., a liquid or gas), for example, via a valve (not shown) provided in the thrust plate assembly 140. The pressurized fluid may prevent or slow plating fluid from flowing into the cavity if a leak forms in either of the sealing members 130 or 150.

The sealing members 130 and 150 may be made of any suitable material or combination of materials. For example, the sealing members 130 and 150 may be made of nitrile, buna-n, silicone, rubber, neoprene, polyurethane and teflon encapsulated elastomers. For some embodiments, the sealing members 130 and 150 may be made, at least partially, of a perfluoroelastomer material, such as perfluoroelastomer materials sold under the trade names Chemraz®, Kalrez®, Perlast®, Simriz®, and Viton®.

Figure 3A:
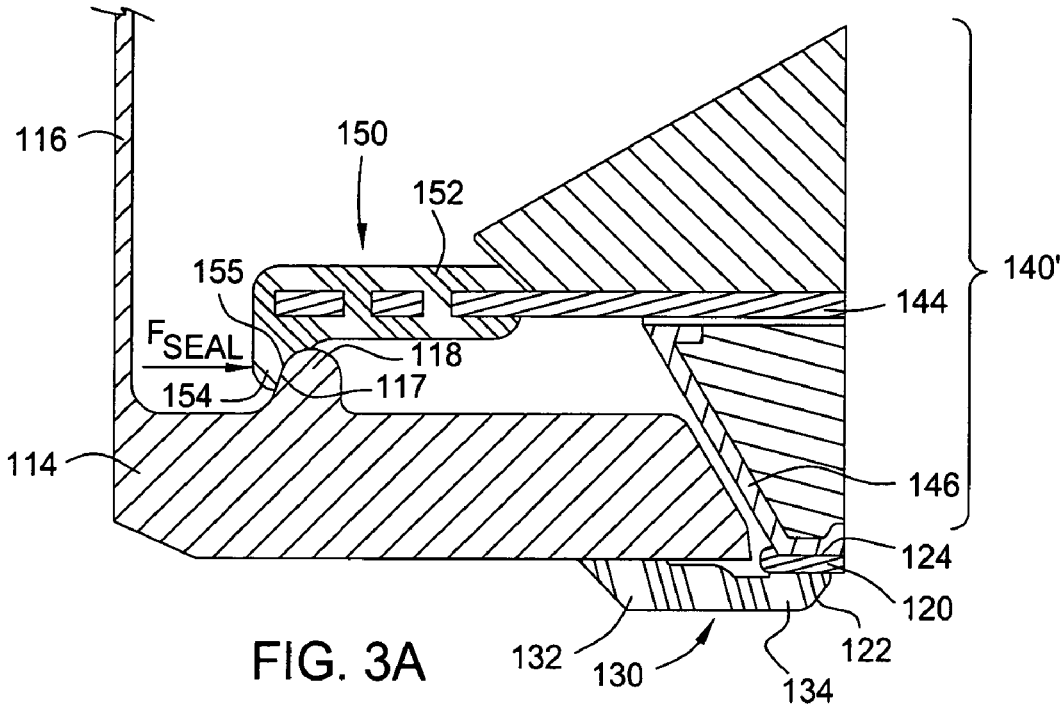
FIG. 3 is a detailed sectional view of the substrate support member of FIG. 2.

FIG. 3A is a detailed sectional view of the substrate holding assembly 110, which shows the front side sealing member 130 and back side sealing member 150 in greater detail. As illustrated, the front side sealing member 130 may include a base portion 132 attached to the substrate support member 114 and a body portion 134, extending from the base portion 132, for engaging the plating surface 122 of the substrate 120.

The front side sealing member 130 may also be designed so that the body portion 134 engages the plating surface 122 in proximity to the beveled edge of the substrate 120 in an effort to maximize the area of the plating surface 122 exposed to the plating solution. For example, the body portion 134 may engage the plating surface 122 within 2 millimeters (mm) of the beveled edge of a 300 mm diameter substrate 120, resulting in a utilization of over 97% of the plating surface 122.

Radial Seal for Contact Force Control

The back side sealing member 150 may include a body portion 152 attached to the thrust plate assembly 140 and an annular portion 154 extending from the base portion 152. As illustrated, the annular portion 154 may be substantially perpendicular to the body portion 152. The back side sealing member 150 may be adapted to engage the annular ring 118 formed on the top surface of the substrate support member 114 with the annular portion 154. Particularly, an inner surface 155 of the annular portion 154 may engage an outer surface 117 of the annular ring 118. Thus, the annular portion 154 may exert a radial sealing force ($F_{RADIAL}$) directed radially inward (as indicated by the arrows), substantially parallel to the substrate 120. Accordingly, in this embodiment, the back side sealing member 150 may be referred to as a radial seal.

The size and shape of the back side sealing member 150 may be designed to ensure adequate radial force is generated to provide adequate sealing. For example, an outer diameter of the back side radial seal 150 (to an outer surface of the annular portion 154) may be chosen to be slightly larger (e.g., less than 5 mm) than an outer diameter of the annular ring 118. As the thrust plate 140 is lowered to secure the substrate 120, the annular portion 154 may flex radially outward to engage the annular ring 118, resulting in an adequate radial seal without excessive downward force. Further, as illustrated, an inner edge of the back side sealing member 150 where the annular portion 154 extends from the body portion 152 may be substantially rounded to mate with a substantially rounded top surface of the annular ring 118.

Because the back side sealing member 150 may exert radial sealing forces that are substantially parallel to the substrate 120, the forces required for back side sealing are essentially decoupled from the downward force applied to the substrate 120 to form a seal between the plating surface 122 and the front side sealing member 130. This is in contrast to conventional back side sealing members, such as O-rings and face seals that typically contact the non-plating surface 124 of the substrate 120. O-rings and face seals typically require a downward force to press against the non-plating surface 124 of the substrate 120 to form a seal, which may stress the substrate 120 and result in damage. By providing a radial seal that does not rely on downward force applied to the substrate 120, the back side sealing member 150 may allow better control of the forces applied to the substrate 120.

With the back side sealing force ($F_{RADIAL}$) essentially decoupled from the front side sealing force, the net force ($F_{SUBSTRATE}$) applied to the substrate 120 (neglecting the weight of the wafer) is essentially the difference between the downward force applied by the contacts ($F_{CONTACTS}$) and the upward force applied by the seal ($F_{SEAL}$):

$$F_{SUBSTRATE}=F_{CONTACTS}-F_{SEAL}.$$

Since the substrate is not moving, the net force is zero ($F_{SUBSTRATE}=0$). Therefore, the force on the seal may be balanced by the electrical contact on the opposite side of the substrate:

$$F_{SEAL}=F_{CONTACTS}.$$

While the net force on the substrate 120 may be zero, the substrate 120 may still be stressed (i.e., compressed) by the opposing forces applied by the contacts 146 and the front side sealing member 130. Therefore, the front side sealing member 130 and electrical contacts 146 may be optimized to ensure adequate front side sealing and electrical contact, respectively, while minimizing the compressive forces applied to the substrate.

Figure 3B:
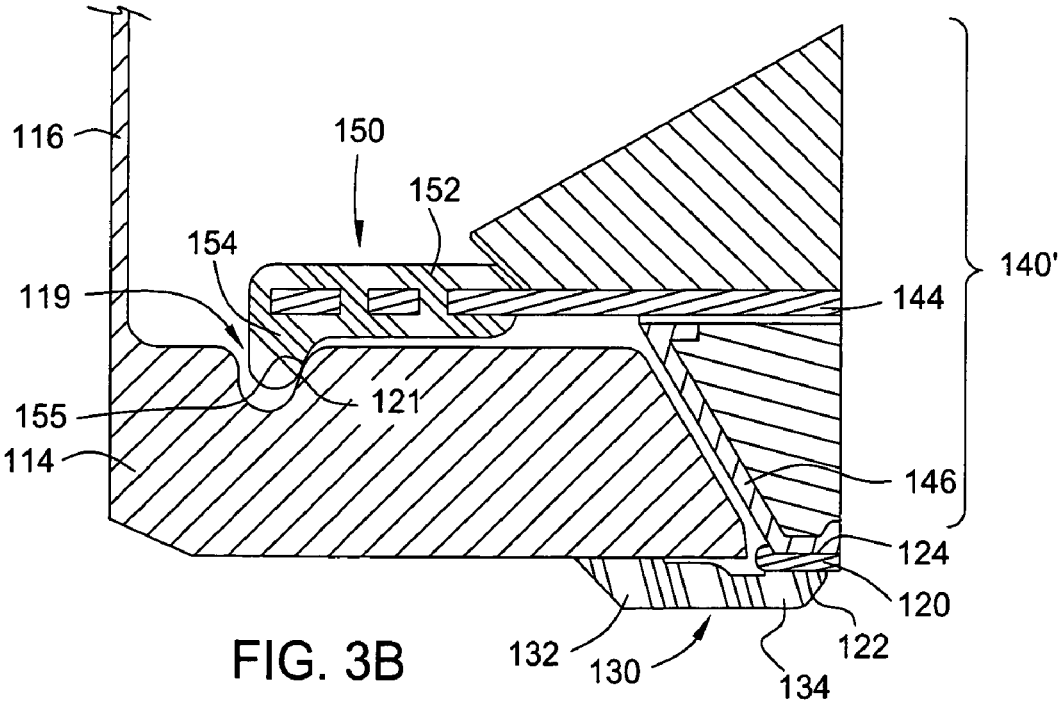

As illustrated in FIG. 3B, for some embodiments, rather than engage an a raised annular ring to form a radial seal, the back side sealing member 150 may engage an annular groove 119 formed in a top surface of the substrate support member 114. For example, the back side sealing member 150 may be adapted so the inner surface 155 of the annular portion 154 engages an inner surface 121 of the annular groove 119 to form a radial seal. For still other embodiments, the back side sealing member 150 may be attached to the substrate support member 114, and engage a surface of the thrust plate assembly 140, as the thrust plate assembly 140 is lowered to secure the substrate 120. For such embodiments, the back side sealing member may engage an annular ring or groove formed in a mating surface of the thrust plate assembly 140.

For some embodiments, the electrical contacts 146 may be adapted to contact the non-plating surface 124 of the substrate 120 at a substantially equal distance from the beveled edge of the substrate 120 as the body portion 134 of the front side sealing member 130 engages the plating surface 122. For example, if the body portion 134 engages the plating surface 122 approximately 2 mm from the beveled edge of the substrate, the electrical contacts 146 may be adapted to contact the non-plating surface 124 approximately 2 mm from the beveled edge of the substrate. Placing the contacts 146 and the front side sealing member 130 in opposing positions may allow better control of the opposing forces on the substrate 120.

Figure 4A:
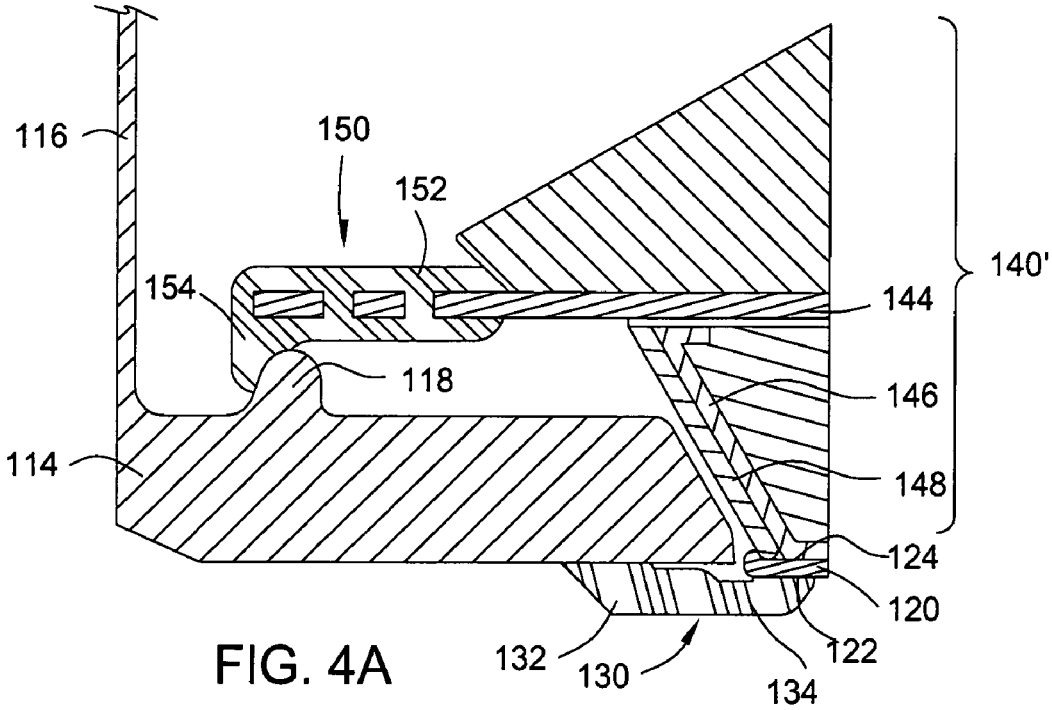
FIG. 4 is a detailed sectional view of a substrate support member according to another embodiment of the present invention.

As illustrated in FIG. 4A, for some embodiments, a back side substrate sealing member 148 may be attached adjacent the electrical contacts 146. The back side substrate sealing member 148 may be adapted to engage the non-plating surface 124 of the substrate 120 radially outward from the electrical contacts, thus shielding the electrical contacts 146 from plating solution. The back side substrate sealing member 148 may be formed as an annular ring disposed radially outward from the electrical contacts 146 on a bottom surface of the thrust plate assembly 140. For different embodiments, the back side substrate sealing member 148 may be used in addition to, or instead of, the back side sealing member 150.

Figure 4B:
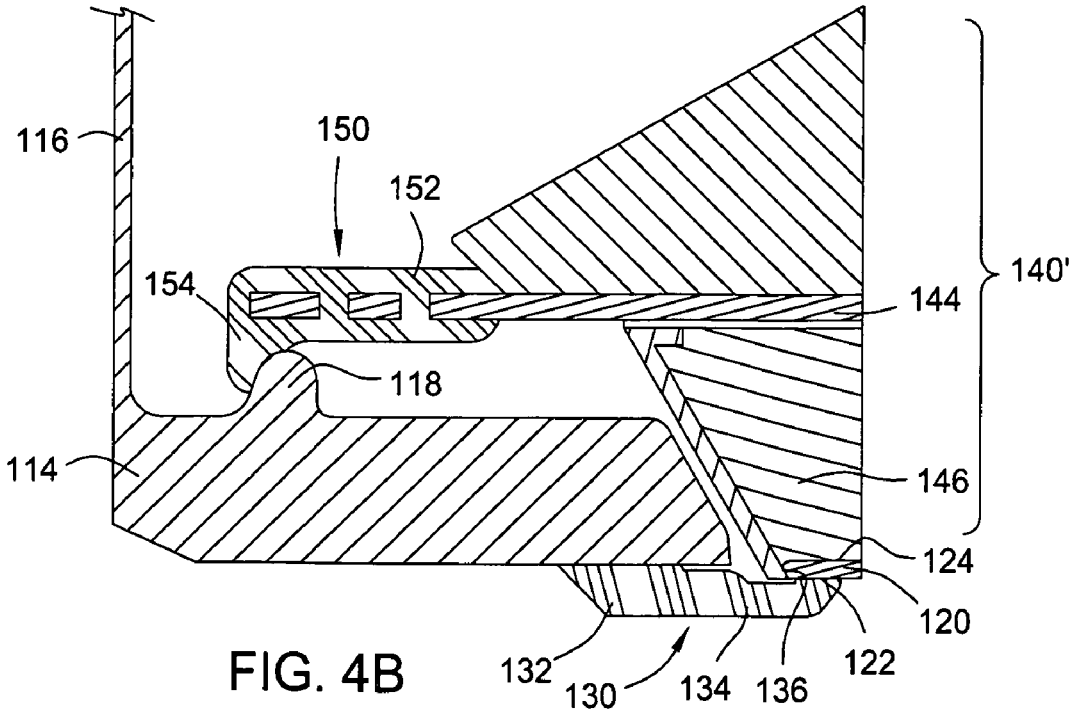

As illustrated in FIG. 4B, the electrical contacts 146 may be adapted to electrically contact a beveled edge 126 of the substrate 120, rather than the non-plating surface 124. An advantage to electrically contacting the beveled edge 126 of the substrate 120 may be a reduction or elimination of a conductive layer formed on the non-plating surface 124, which may shorten or eliminate a processing step required to remove the conductive layer after plating.

Figure 5:
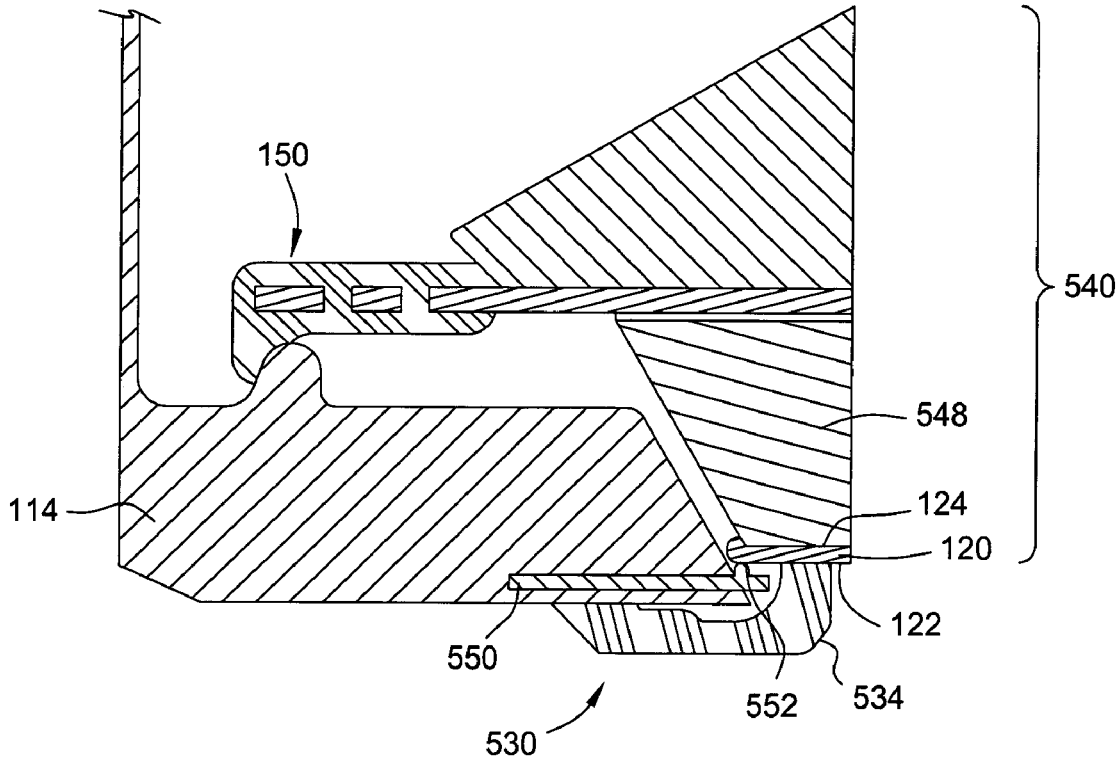
FIG. 5 is a detailed sectional view of a substrate support member according to another still embodiment of the present invention.

As illustrated in FIG. 5, the back side sealing member 150 may also be utilized in a substrate holding apparatus that electrically contacts the plating surface 122 of the substrate 120. Any suitable configuration of electrical contacts may be used to electrically contact the plating surface 122 of the substrate 120. In this configuration, electrical contacts 552 may electrically contact the plating surface 122 of the substrate 120. As illustrated, an annular portion 534 of a front side sealing member 530 may sealingly engage the plating surface 122 radially inward from the electrical contacts 552, thereby preventing the flow of plating fluid to the electrical contacts 552. However, any other suitable type sealing arrangement may also be used to prevent the flow of plating fluid to the electrical contacts 552.

The thrust plate assembly 540 may include a lower member 548 to provide a downward force on the non-plating surface 124 (previously applied by the contacts 146) in order to ensure adequate sealing between the plating surface 122 and the front side sealing member 530, as well as adequate electrical contact between the plating surface 122 and the contacts 552.

As previously described, the forces required for back side sealing are essentially decoupled from the downward force applied to the substrate 120. Therefore, assuming the net force applied to the substrate 120 is zero, the downward force applied by the (lower member 448 of the) thrust plate assembly 540 is essentially equal to the upward force applied by the contacts 552 and the front side sealing member 530:

$$F_{THRUST_PLATE}=F_{SEAL}+F_{CONTACTS}$$

Therefore, the front side sealing member 530, electrical contacts 552 and thrust plate assembly 540 may be optimized to ensure adequate front side sealing and electrical contact while minimizing the compressive forces applied to the substrate 120.

Figure 6:
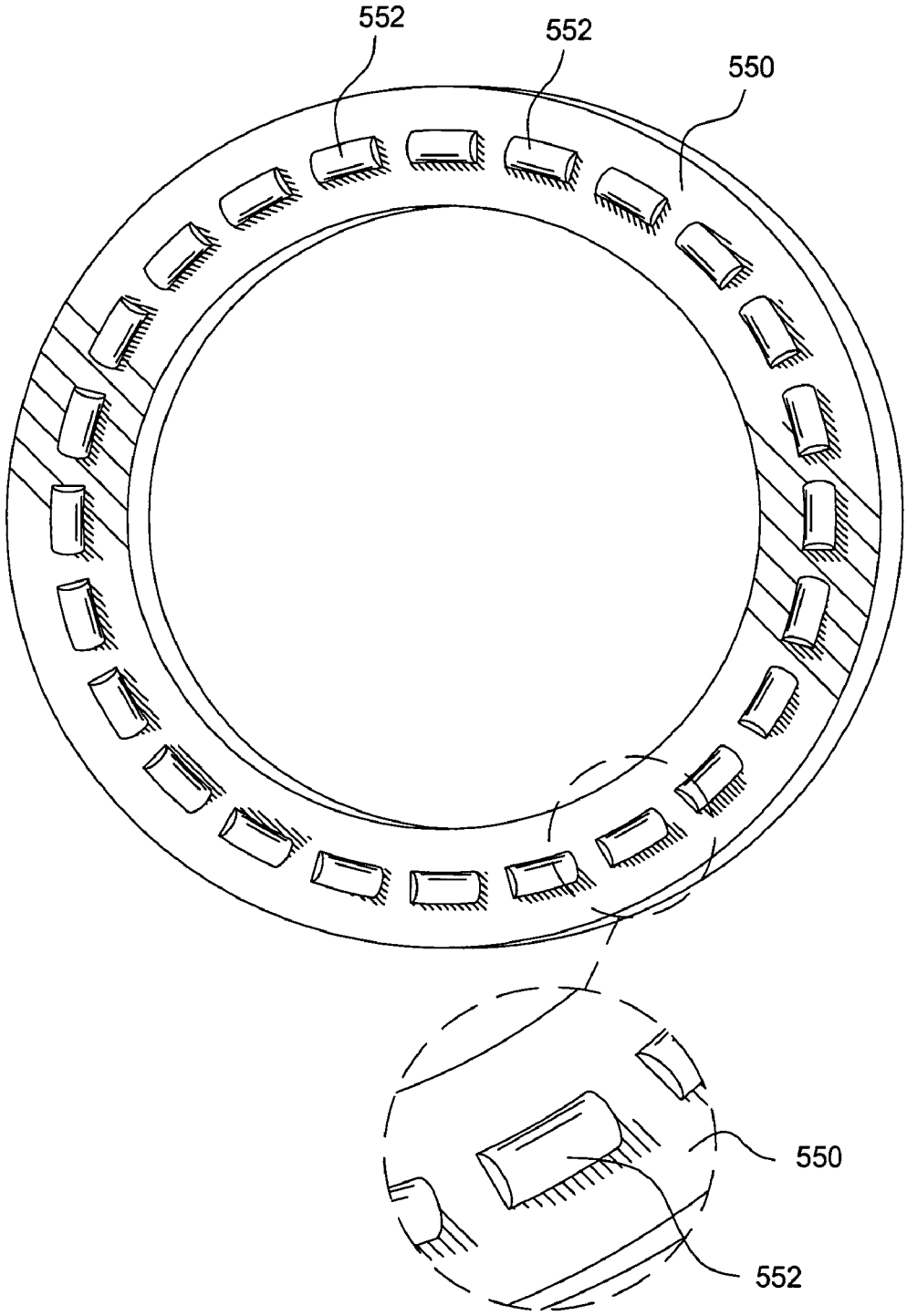
FIG. 6 illustrates a contact ring according to one embodiment of the present invention.

As illustrated, the electrical contacts 552 may extend from a conductive contact ring 550. FIG. 6 illustrates a general perspective view of the contact ring 550 according to one embodiment of the present invention. To supply power to the contacts 552, the contact ring 550 may be connected to a power supply at one or more locations. The contact ring 550 and electrical contacts 552 may be made of any suitable conductive material, such as copper (Cu), platinum (Pt), tantalum (Ta), titanium (Ti), gold (Au), silver (Ag), stainless steel or other conducting materials, and may be made of the same material. The electrical contacts may be any suitable shape. For example, as illustrated, the electrical contacts 552 may be semi-cylindrical. The number of electrical contacts 552 may vary, for example, with substrate diameter and/or current required for proper plating.

For different embodiments, a contact ring and an annular sealing member may be separate components or may be integrated with a substrate support member. For example, as illustrated in FIG. 5, the contact ring 550 may be molded in the substrate support member. Electrical contacts 552 may extend up from the integrated contact ring 550 or may extend radially inward from the integrated contact ring to electrically contact a plating surface of a substrate.

While the foregoing is directed to embodiments of the present invention, other and further embodiments of the invention may be devised without departing from the basic scope thereof, and the scope thereof is determined by the claims that follow.

The invention claimed is:

1. An apparatus for securing a substrate in a processing system, comprising:

a support ring adapted to receive the substrate, the support ring having a seal engaging means formed on a surface therein;

a thrust plate assembly adapted to exert a securing force on the substrate to secure the substrate to the support ring; and a sealing member attached to the thrust plate assembly, wherein the sealing member is adapted to exert a substantially radial sealing force against the seal engaging means.

2. The apparatus of claim 1, wherein the seal engaging means comprises an annular ring extending from the support ring and the sealing member is adapted to exert a substantially radial sealing force on an outer surface of the annular ring.

3. The apparatus of claim 2, wherein the sealing member comprises a body portion and an annular portion, wherein the body portion is attached to the thrust plate assembly and the annular portion extends from the body portion to engage the outer surface of the annular ring.

4. The apparatus of claim 3, wherein an inner surface of the sealing member where the annular portion extends from the body portion is substantially rounded to mate with a substantially rounded surface of the annular ring.

5. The apparatus of claim 3, wherein an outer diameter of the sealing member, measured to an outer surface of the annular portion, is less than 5 mm greater than an outer diameter of the annular ring.

6. The apparatus of claim 1, wherein the seal engaging means comprises an annular groove formed in a surface of the support ring and the sealing member is adapted to exert a substantially radial sealing force on an inner surface of the annular groove.

7. The apparatus of claim 1, further comprising a plurality of electrical contacts adapted to engage a plating surface of the substrate and the support ring comprises a contact ring.

8. The apparatus of claim 1, further comprising a plurality of electrical contacts adapted to engage a non-plating surface of the substrate.

9. The apparatus of claim 8, wherein the electrical contacts are attached to the thrust plate assembly.

10. The apparatus of claim 9, wherein the electrical contacts are attached to a conductive plate of the thrust plate assembly.

11. An apparatus for securing a substrate in a processing system, comprising:

a support ring adapted to receive the substrate, the support ring having an annular ring extending from a surface thereof;

a thrust plate assembly adapted to exert a securing force on the substrate to secure the substrate to the support ring;

a plurality of electrical contacts adapted to engage the substrate;

a first sealing member attached to the thrust plate assembly, wherein the first sealing member is adapted to exert a sealing force against the annular ring, wherein the sealing force is directed substantially radially inward towards a center of the support ring; and a second sealing member attached to the support ring, the second sealing member adapted to engage a plating surface of the substrate.

12. The apparatus of claim 11, wherein the first and second sealing members form a cavity enclosing the electrical contacts.

13. The apparatus of claim 12, wherein the cavity is pressurized with a fluid.

14. The apparatus of claim 13, wherein the fluid is a gas.

15. The apparatus of claim 11, wherein the electrical contacts are adapted to engage a non-plating surface of the substrate.

16. The apparatus of claim 15, wherein the electrical contacts are adapted to engage the non-plating surface of the substrate at a substantially equal distance radially inward from an edge of the substrate as the second sealing member engages the plating surface of the substrate.

17. The apparatus of claim 11, wherein the first sealing member comprises a body portion and an annular portion, wherein the body portion is attached to the thrust plate assembly and the annular portion extends from the body portion to engage an outer surface of the annular ring.

18. An apparatus for securing a substrate in a processing system, wherein the substrate includes a plating side, a back side, and an edge, comprising:

a substrate support member adapted to receive the substrate;

a thrust plate assembly adapted to exert a securing force on the substrate to secure the substrate to the substrate support member;

a plurality of electrical contacts adapted to electrically contact the back side of the substrate; and a sealing member attached to the substrate support member adapted to engage the front side of the substrate, wherein the sealing member is adapted to prevent a fluid disposed on the front side of the substrate from contacting the edge and the back side of the substrate.

19. The apparatus of claim 18, wherein the electrical contacts are disposed on a surface of the thrust plate assembly.

20. The apparatus of claim 18, wherein the electrical contacts are adapted to engage the back side of the substrate at a substantially equal distance radially inward from the edge of the substrate as the sealing member engages the front side of the substrate.

21. The apparatus of claim 18, wherein the sealing member is adapted to engage the front side of the substrate within 2 mm of the edge of the substrate.

22. The apparatus of claim 18, wherein the electrical contacts are attached to an electrically conductive plate attachable to a power supply for providing an electrical bias to the electrical contacts.

23. An apparatus for securing a substrate in a processing system, wherein the substrate includes a plating side, a back side, and an edge, comprising:

a substrate support member adapted to receive the substrate;

a thrust plate assembly adapted to exert a securing force on the substrate to secure the substrate to the substrate support member;

a plurality of electrical contacts adapted to electrically contact the back side of the substrate;

a first sealing member attached to the substrate support member adapted to engage the front side of the substrate; and a second sealing member adapted to engage the back side of the substrate radially outward from the electrical contacts.

* * * * *